US006453710B1

(12) United States Patent
Andresen et al.

(10) Patent No.: US 6,453,710 B1
(45) Date of Patent: Sep. 24, 2002

(54) METHOD AND APPARATUS FOR MANUFACTURING A HELICALLY-WOUND LOCK-SEAM TUBE HAVING AIR NOZZLES

(75) Inventors: Werner J. Andresen, Haderslev (CH); Rudolf Binggeli, Wohlen (DK)

(73) Assignee: Lindab AB, Bastad (SE)

( * ) Notice: Subject to any disclaimer, the term of this patent is extended or adjusted under 35 U.S.C. 154(b) by 0 days.

(21) Appl. No.: 09/654,763

(22) Filed: Sep. 5, 2000

(30) Foreign Application Priority Data

Sep. 6, 1999 (SE) ..... 9903144

(51) Int. Cl.[7] ..... B21C 37/12

(52) U.S. Cl. ..... 72/49; 72/50; 72/368; 72/370.27; 29/33 D

(58) Field of Search ..... 72/49, 50, 367.1, 72/368, 370.27; 29/33 D, 33 T, 509, 521, 243.517, 243.518

(56) References Cited

U.S. PATENT DOCUMENTS

| | | | | |
|---|---|---|---|---|
| 3,546,910 A | | 12/1970 | Jensen | |
| 3,620,115 A | | 11/1971 | Zieg et al. | |
| 3,753,367 A | * | 8/1973 | Trihey | 72/49 |
| 4,567,742 A | | 2/1986 | Castricum | |
| 4,577,281 A | | 3/1986 | Sato et al. | |
| 4,578,985 A | | 4/1986 | Winter | |
| 5,001,819 A | * | 3/1991 | Harrop | 72/50 |
| 5,609,055 A | * | 3/1997 | Castricum | 72/49 |
| 5,881,442 A | * | 3/1999 | Hultberg et al. | 72/49 |

FOREIGN PATENT DOCUMENTS

| | | | | |
|---|---|---|---|---|
| DE | 2832508 | * | 2/1979 | 72/49 |
| JP | 20928 | * | 12/1966 | 72/49 |
| RU | 854491 | * | 8/1981 | 72/49 |
| WO | WO 98/51424 | | 11/1998 | |

OTHER PUBLICATIONS

"Activent—The Active Thermal Displacement Ventilation System" by ABB Flakt Oy in 1995.

"System Activent—Framtidens luftforingsteknik" by ABB Flakt Nov. 1995.

"System Activent—Teknisk Broschyr" by ABB Contracting.

"System Activent—Sprider luftgladje overallt" by ABB Contracting.

* cited by examiner

*Primary Examiner*—Ed Tolan
(74) *Attorney, Agent, or Firm*—Weingarten, Schurgin, Gagnebin & Lebovici LLP

(57) ABSTRACT

In a method of manufacturing a helically-wound lock-seam tube for a ventilation duct system, the tube is provided with a plurality of air nozzles through its wall. The method involves the steps of: feeding a strip of sheet metal from a supply to a punching and pressing unit; punching and pressing the strip in the punching/pressing unit to form two rows of spaced openings through the strip; feeding the punched strip to a roller unit, in which a longitudinal bead is formed in the strip; feeding the punched and beaded strip to a forming head in which the strip is helically-wound to form a tube having a helical lock seam; feeding the helically-wound lock-seam tube out of the forming head; and cutting the tube into desired lengths. The apparatus has components for carrying out the various method steps, and the finished tube is provided with a desired pattern of air nozzles.

20 Claims, 7 Drawing Sheets

METHOD AND APPARATUS FOR MANUFACTURING A HELICALLY-WOUND LOCK-SEAM TUBE HAVING AIR NOZZLES

TECHNICAL FIELD

The present invention generally relates to the field of ventilation duct systems, and in particular to the manufacture of helically-wound lock-seam tubes having air nozzles.

BACKGROUND ART

Ventilation ducts of this general type are disclosed in a pamphlet entitled "ACTIVENT—The Active Thermal Displacement Ventilation System" issued by the Finnish company ABB Fläkt Oy in 1995. This known ventilation duct system, referred to as the ACTIVENT system in the following, includes tubes helically formed from a sheet metal strip and having small air nozzles extending through the tube wall and distributed in a helical pattern. Such a tube is shown under the subtitle "Fittings" on page 9 of the above pamphlet.

As is shown on page 2 of the pamphlet, the air nozzles of the tubes of the ACTIVENT system are adapted to evenly distribute air along the entire length of the duct. Secondary air outside the tubes is mixed with the air flowing out of the nozzles to establish the above-mentioned thermal displacement. Systems like this produce a good cooling effect without disturbing draught and they use less supply air than traditional systems.

In the pamphlet, there is no disclosure whatsoever of how the tubes of the ACTIVENT system are manufactured.

It should be mentioned, however, that ventilation tubes like these may be manufactured by means of a so-called tube former, for instance of the general type which is disclosed in the patent U.S. Pat. No. 3,546,910 issued in 1970 and entitled "Lock-seam helical tubing". Tubes produced by means of this known machine are called "Spiro Rib Tubes".

SUMMARY OF THE INVENTION

The present invention aims at providing a technique by means of which helically-wound lock-seam tubes, which are of the basic type mentioned, can be manufactured in a modern and effective manner.

According to the invention, this aim is fulfilled by a method of manufacturing a helically-wound lock-seam tube intended for a ventilation duct system and having a plurality of air nozzles through its wall. The method comprises the steps of:

a) feeding a strip of sheet metal from a supply to a punching and pressing unit;

b) punching and pressing said strip in said punching/pressing unit to form at least one longitudinal row of spaced openings through said strip, each of said openings being defined by a collar formed of strip material and projecting from one surface of said strip;

c) feeding said punched strip to a roller unit, in which at least one longitudinal bead is formed in said strip in parallel with said at least one row of openings;

d) feeding said punched and beaded strip to a forming head in which said strip is helically wound to form a tube having a helical lock seam, wherein each helical turn of said tube has at least one row of spaced openings forming said air nozzles projecting radially out of said tube wall;

e) feeding said helically-wound lock-seam tube out of said forming head; and f) cutting said tube into desired lengths.

The aim of the invention is also fulfilled by an apparatus for manufacturing a helically-wound lock-seam tube intended for a ventilation duct system and having a plurality of air nozzles through its wall. The apparatus comprises:

a) a supply of a sheet metal strip;

b) a punching/pressing unit for punching and pressing said strip fed from said supply to form at least one longitudinal row of spaced openings through said strip, each of said openings being defined by a collar formed of strip material and projecting from one surface of said strip;

c) a roller unit for rolling said punched strip fed from said punching/pressing unit to form at least one longitudinal bead in said strip in parallel with said at least one row of openings;

d) a forming head for forming said punched and beaded strip to a helically-wound lock-seam tube, wherein in each helical turn of said tube has at least one row of spaced openings forming said air nozzles projecting radially out of said tube wall;

e) means for feeding said helically-wound lock-seam tube out of said forming head; and f) means for cutting said tube into desired lengths.

Further, the aim of the invention is fulfilled by a helically-wound lock-seam tube for a ventilation duct system, said tube having a plurality of air nozzles through its wall and being formed from a sheet metal strip helically formed in helical turns defined by a helical lock seam, wherein each helical turn of said tube comprises at least one row of spaced openings forming said plurality of air nozzles projecting radially out of said tube wall, and wherein each helical turn of said strip further comprises a helical bead formed in said strip in parallel with said at least one row of spaced openings forming said air nozzles.

The invention gives several advantages. By the technique suggested, tubes of the present type may be manufactured in line and easily cut into desired lengths. When the tube diameter is to be changed, normally by replacing the forming head, the parameters related to the tube diameter are easily adjustable. For instance, the operation of the punching and pressing unit is easy to adjust so that the positioning of the openings to be punched, which will form the air nozzles of the finished tube, is adjusted to the new tube diameter.

In a preferred embodiment, the punching/pressing unit comprises two members, one of which is displaceable with respect to the other in order to punch a first row of openings which are offset relative to a second row of openings, the openings of these rows being more or less offset with respect to each other. By adjustment of the displaceable punching/pressing member, the positioning of the two rows of openings may be adjusted in such a manner that the air nozzles of the finished tube are arranged in axial rows parallel with the center axis of the tube. Further, it is preferred that the bead to be formed in the following roller unit is positioned between and two rows of openings.

Preferably, the punching/pressing unit may operate both continuously and intermittently. In the first case, the air nozzles will be equidistantly spaced in a helical row throughout the tube, whereas in the second case the finished tube will have at least one axially extending surface that has no air nozzles. By operating the punching/pressing unit continuously or intermittently, various air nozzle patterns may easily be provided on the finished tube, such as 360°, 270°, 180°, 90° and two times 90° around the periphery of the tube. The operation of the punching/pressing unit is controlled by means of a computer in which various nozzle patterns may be programmed.

In still another preferred embodiment, the angle between the center axis of the tube and the strip feeding direction in the roller unit is adjustable in accordance with the diameter of the tube, so that the strip feeding direction between the strip output of the punching/pressing unit and the strip intake of the roller unit is maintained straight, which ensures secure in-line production conditions. Most preferably, the forming head is mounted on a base member which is turnable about a vertical axis, whereas the roller unit is stationary.

The inventive tube is advantageous since it has a greater number of air nozzles per unit of length than prior-art tubes of similar type. This enhances the air distribution from the tube and in the room. The structure of the tube is compact, since each helical turn has at least one row of air nozzles as well as a helical bead.

The bead provided in the roller unit gives special advantages. First, the helical bead on the tube generally has an important stiffening effect. Second, the helical bead protects the air nozzles during handling and transportation of the tube, since the bead preferably projects further radially out of the tube than the air nozzles. Third, the helical bead which preferably is positioned between two parallel rows of air nozzles, has a damping effect on the noise caused by the air flow out of the nozzles.

Preferably, the forming head is of the type in which the tube is formed within an annular body having internal grooves receiving the bead and the air nozzles projecting radially outwards from one surface of the strip which is being formed in the forming head. Owing to this forming head structure, smooth forming of the tube is accomplished, and the bead and the air nozzles do not interfere with the inside surface of the forming head.

BRIEF DESCRIPTION OF THE DRAWINGS

The present invention will now be further described in the following, reference being had to the accompanying schematic drawings which show presently preferred embodiments of the invention.

DESCRIPTION OF PREFERRED EMBODIMENTS OF THE INVENTION

Figure 1:
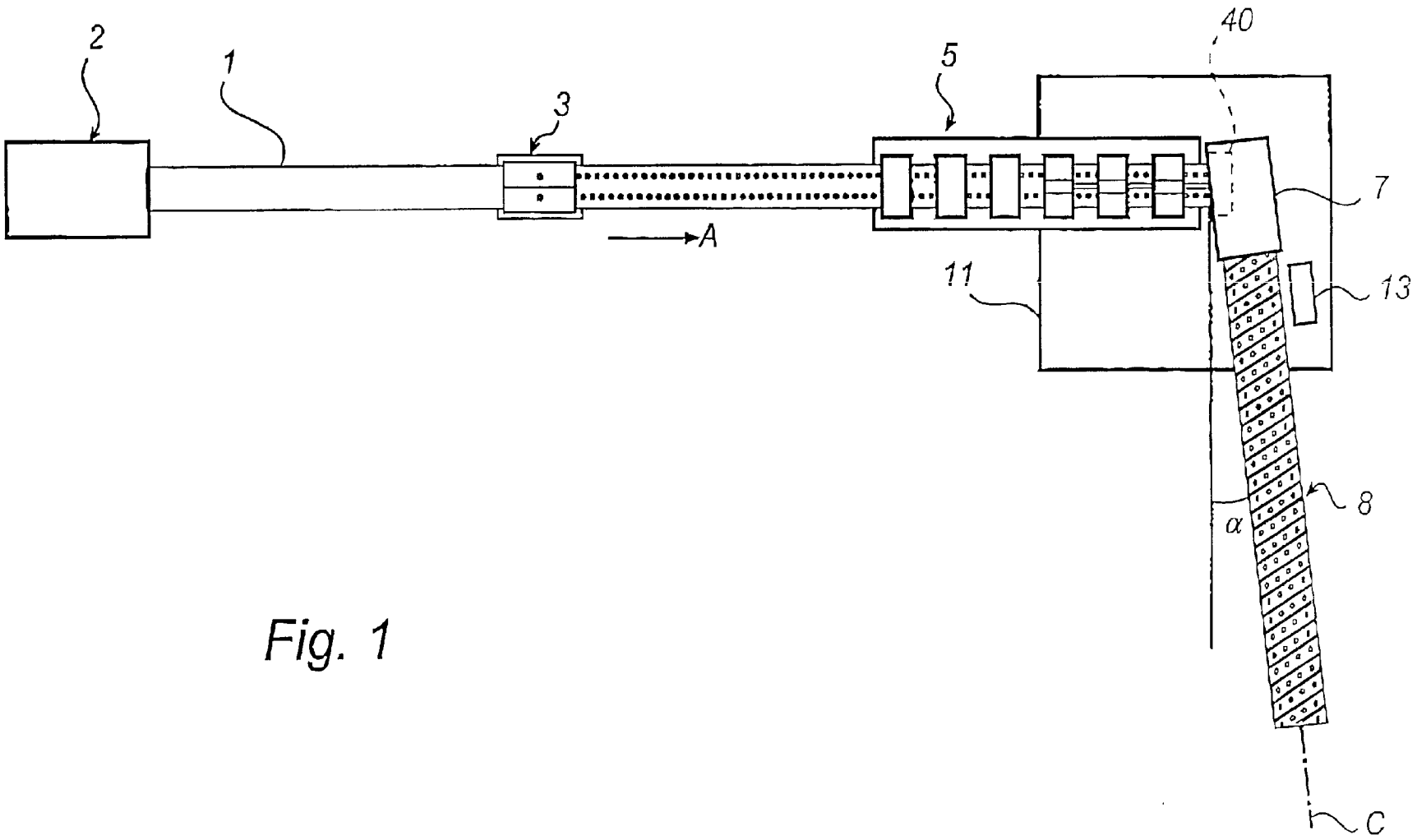
FIG. 1 is a top plan view of an apparatus in accordance with a preferred embodiment of the invention.
Figure 2:
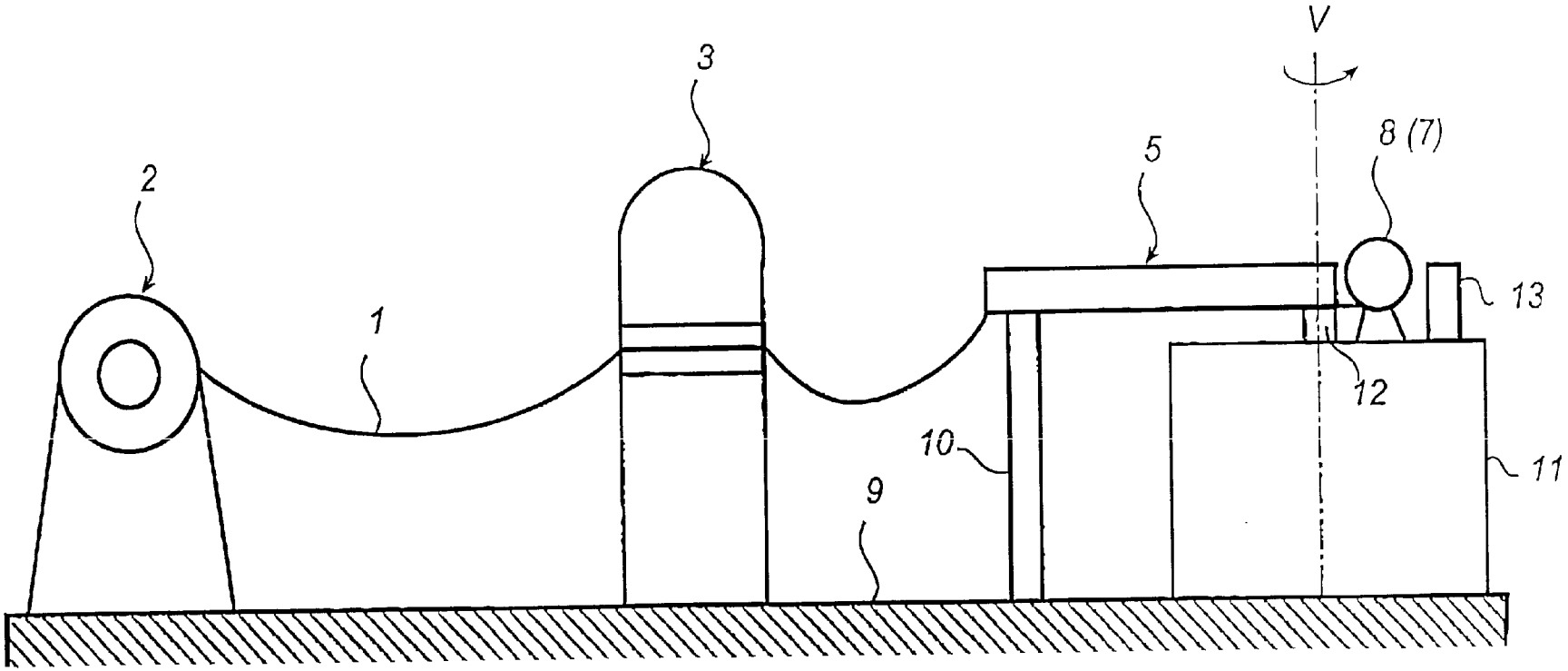
FIG. 2 is a side view of the apparatus shown in FIG. 1.
Figure 3:
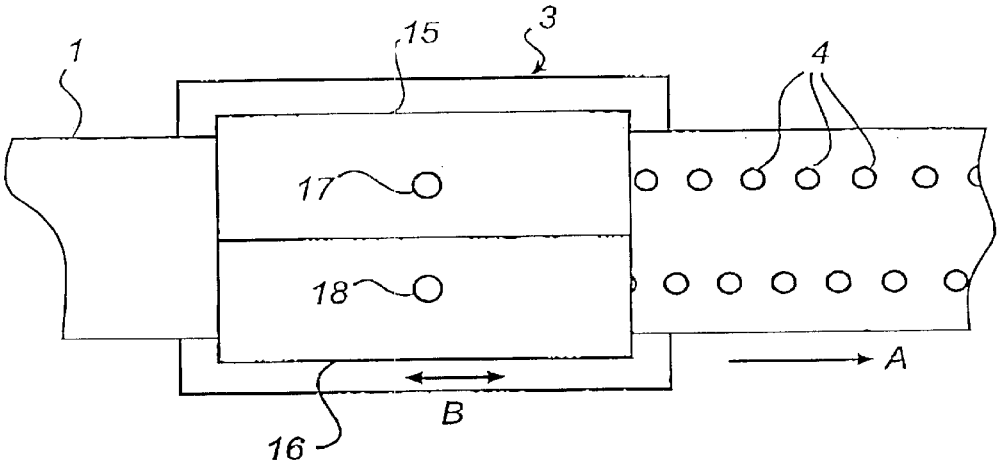
FIG. 3 is a top plan view of a punching and pressing unit included in the apparatus.

FIGS. 1–2 show the main components of an apparatus in accordance with a preferred embodiment of the invention. A strip 1 of sheet metal is fed from a supply 2 to a punching and pressing unit 3, in which two longitudinal, parallel rows of equidistantly spaced openings 4 (see FIG. 3) are punched. The punched strip 1 is then fed to a profiling or roller unit 5, in which a longitudinal bead 6 is formed (see FIG. 4). Then the punched and beaded strip 1 is fed to a forming head 7, in which it is helically wound and lock seamed basically in a manner known per se to form a tube 8 having a circular cross-section.

The roller unit 5 is stationary and at one end supported on the floor 9 by means of a supporting element 10. The other end of the roller unit 5 is supported on a base 11 on which the forming head 7 is mounted. This end of the roller unit 5 is turnably mounted on a hub 12 on the top of the base 11. The entire base 11 and the forming head 7 mounted thereon can be turned about a vertical axis V extending through the hub 12 which forms a bearing. Thus, the base 11 is turnable on the floor 9. Depending on the diameter of the tube 8, the angle $(90+\alpha)°$ between the center axis C of the tube 8 and the feeding direction A in the roller unit 5 is adjustable in a manner which will be described further in the following. An increased tube diameter means a decreased angle $\alpha$ and vice versa. Normally, the angle adjustment is within ten degrees.

In connection with the forming head 7, there is mounted a tube cutting means 13 which is of a type known per se and need not be described in detail. The finished tube 8 may be cut in desired lengths.

The apparatus also includes means for feeding the strip 1 through the production line and for feeding the finished tube 8 out of the forming head 7. Basically, these means are known per se and need not be described in detail here. For the sake of completeness, a strip drive roller 40 adjacent the forming head 7 is schematically shown in FIG. 1. By this drive roller 40, the helically-wound lock-seam tube 8 is pushed or fed out of the forming head 7.

Figure 6:
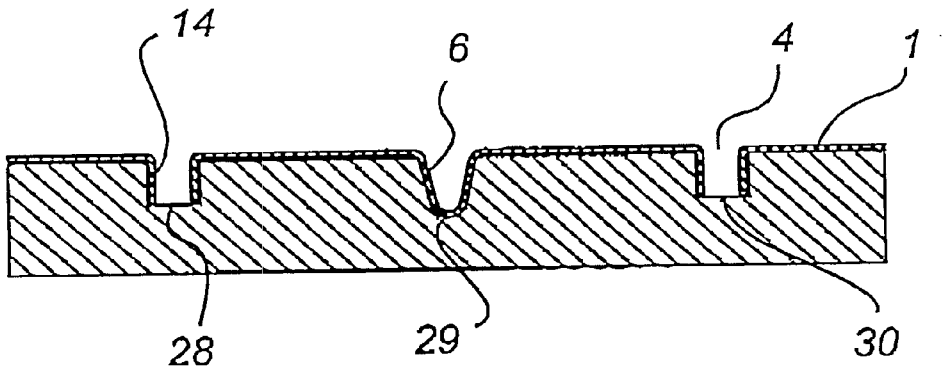
FIG. 6 is a cross-section of a strip intake portion of the forming head.
Figure 7:
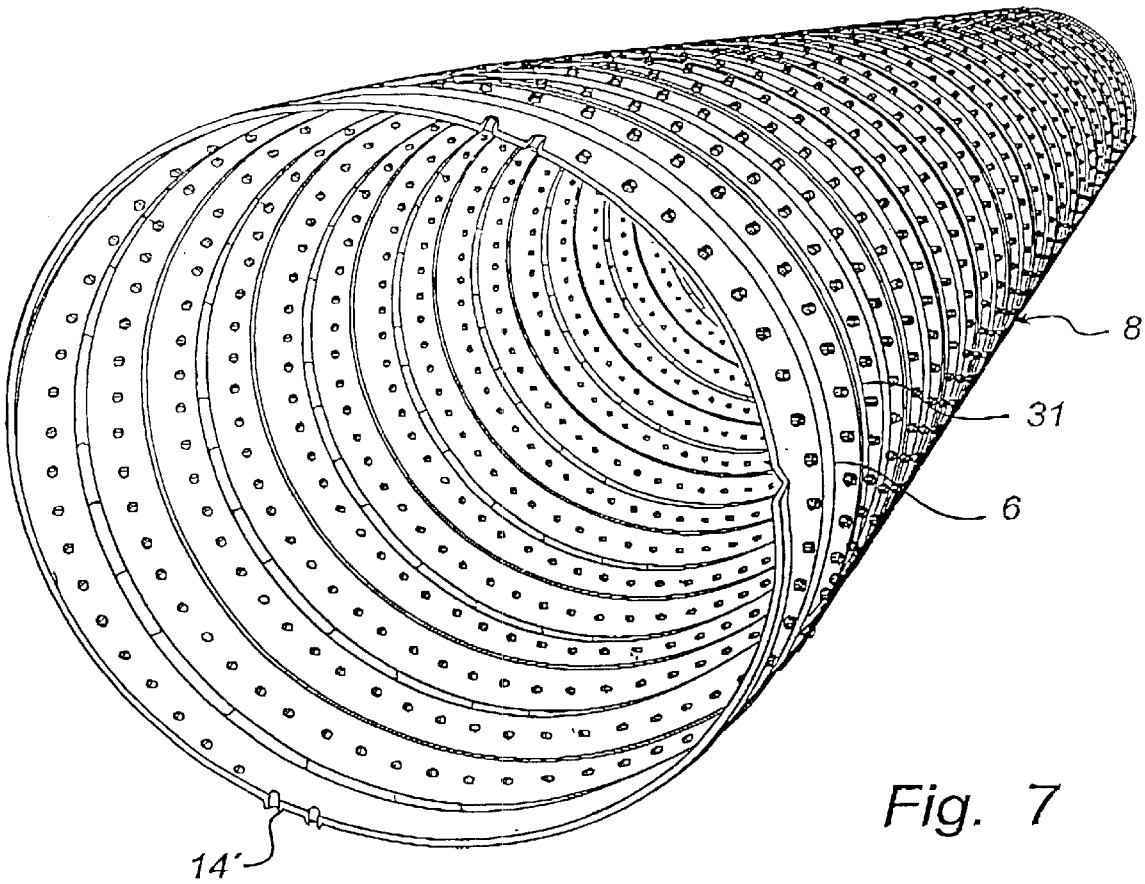
FIG. 7 is a perspective view of a tube manufactured by means of the apparatus in accordance with the preferred embodiment of the invention.

In the punching/pressing unit 3 (see FIG. 3), the strip 1 is machined to form the two rows of openings 4, each of which is defined by a collar 14 formed of strip material, as is best seen in FIG. 6. For each collar 14, the strip 1 is punched to provide a small hole which then is pressed radially to form the opening 4 defined by the pressed collar 14. The collars 14 project downwardly from the strip 1 and form a plurality of air nozzles 14' on the finished tube 8 (see FIGS. 7–8).

The punching/pressing unit 3 comprises two members 15, 16, one of which 16 is displaceable (double arrow B) with respect to the other 15 in parallel with the strip feeding direction A. By adjusting the displaceable punching/pressing member 16 in the direction of the arrow B, the offset between the openings 4 of the two rows may be adjusted. This offset adjustment is necessary when the tube diameter is changed in order to arrange the air nozzles 14' of the tube 8 in axial rows parallel with the center axis C of the tube 8. An increasing tube diameter means less offset between the two rows of openings 4 and vice verse.

The active punching/pressing means of the two members 15, 16 are only shown schematically with reference numerals 17 and 18. In practice, these punching/pressing means 17, 18 consist of spring-loaded stamping elements (now shown).

Figure 4:
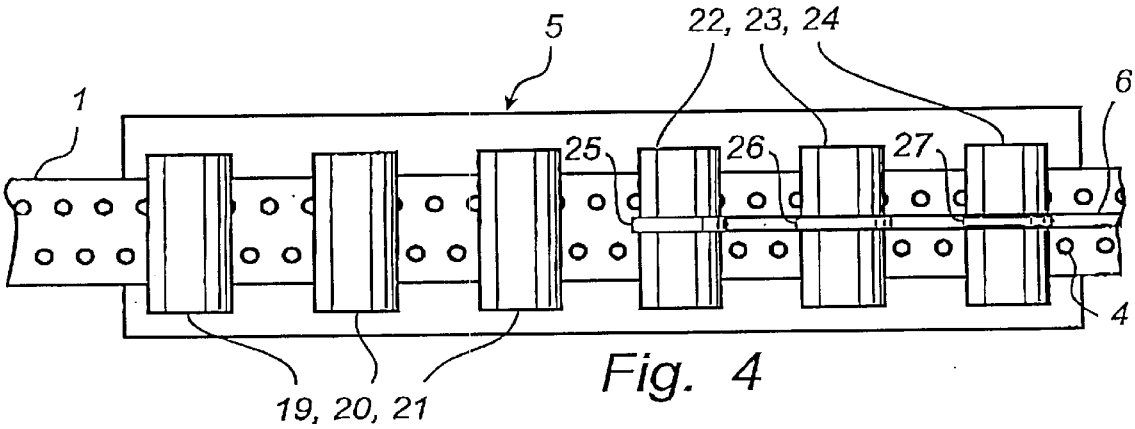
FIG. 4 is a top plan view of a roller unit included in the apparatus.

The roller unit 5 shown in FIG. 4 comprises a first group of rollers 19–21 which bend the longitudinal edge portions of the strip 1 as a preparation for the lock seam, and a second group of rollers 22–24 which form the bead 6. The rollers 22–24 of the second group have peripheral ridges 25–27 which are roll-pressed against the upper surface of the punched strip 1 and which thereby provide the longitudinal bead 6 of the strip 1. As can be seen, the longitudinal bead 6 is positioned between the two rows of openings 4 and in parallel therewith. The transverse width of the peripheral ridges 25–27 decreases in the strip feeding direction A.

Figure 5:
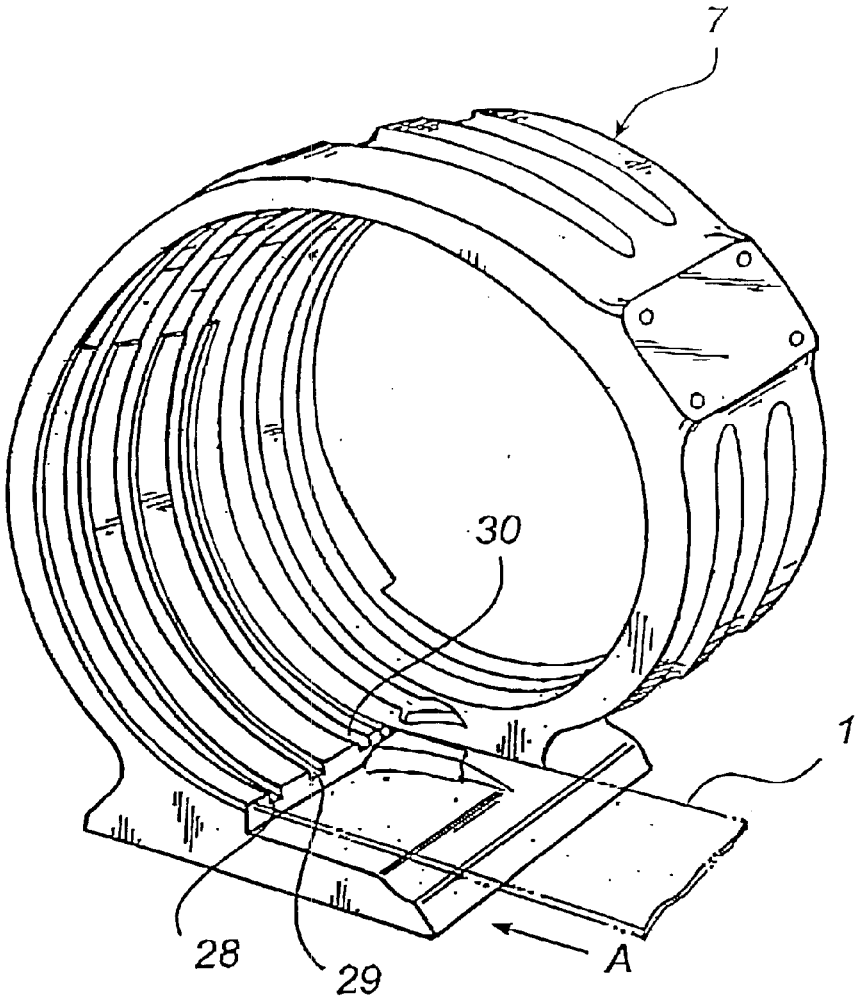
FIG. 5 is a perspective view of a forming head included in the apparatus.
Figure 9:
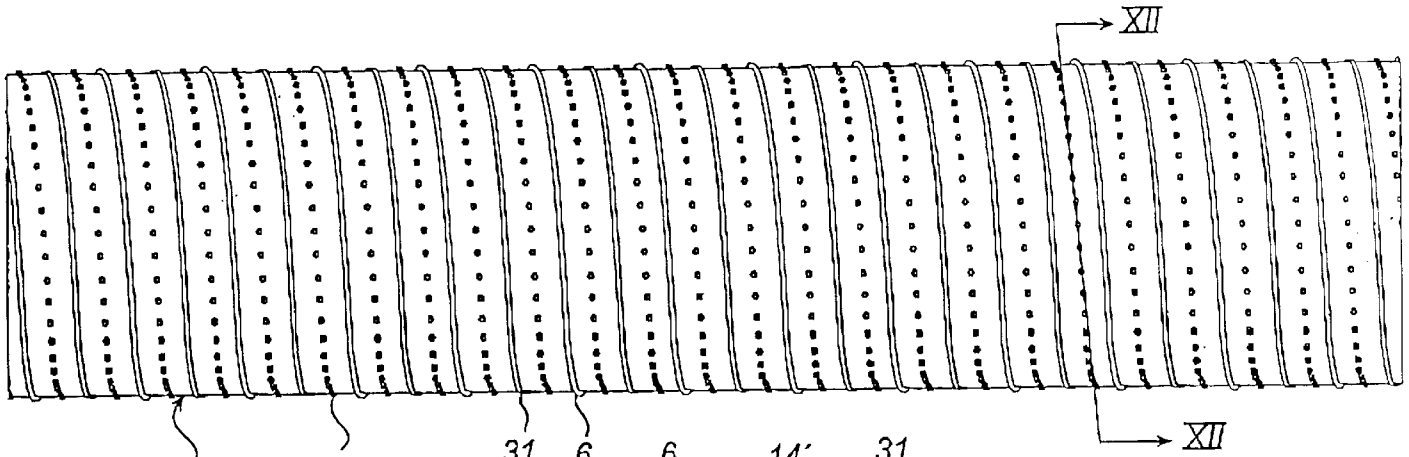
FIG. 9 is a side view of the tube of FIG. 7.
Figure 10:
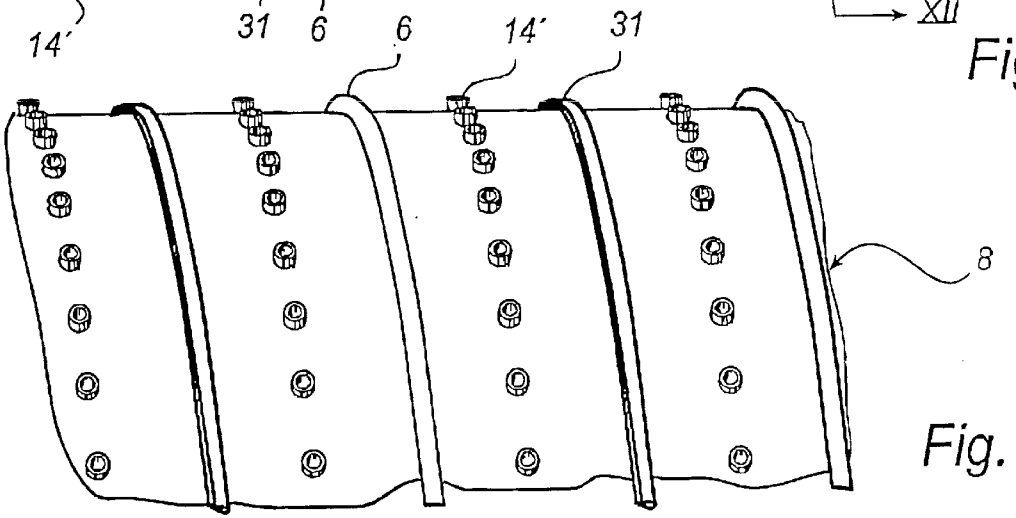
FIG. 10 illustrates, on a larger scale, a cut-away outer wall portion of the tube shown in FIG. 9.
Figure 11:
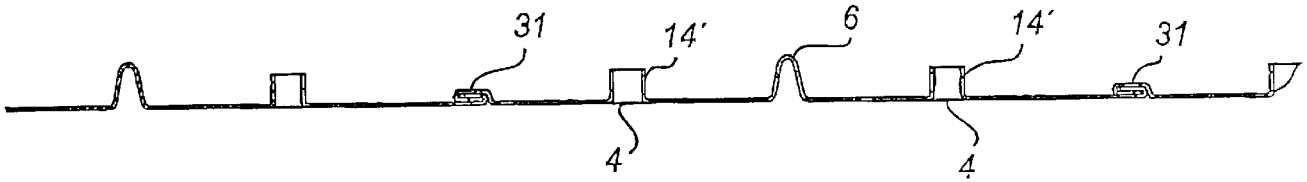
FIG. 11 is a sectional view of the wall of the tube.

The forming head 7 shown in FIG. 5 comprises an annular body with three internal grooves 28–30 for receiving the two rows of collars 14 and the bead 6 therebetween. Thus, the strip 1, which is indicated by ghost lines in FIG. 5, is fed into the forming head 7 and helically wound to form the tube 8. The longitudinal edge portions of the strip 1 are interlocked in a helical lock seam 31 in a manner known per se (see FIGS. 9–11). The depths of the grooves 28–30 are such that the top portions of the collars 14 and the bead 6 do not interfere with the bottom of the respective groove, in order to secure safe production. FIG. 6 shows that the radial projection of the bead 6 is greater than the radial projection of the collars 14 (and, or course, of the lock seam 31, see FIG. 11). Thus, the helical bead 6 will protect the top of the air nozzles 14' when the tube 8 is packaged, handled or transported. In practice, there is a clearance of 2–3 mm between the walls of the grooves 28–30 and the collars 14 and the bead 6.

Figure 8:
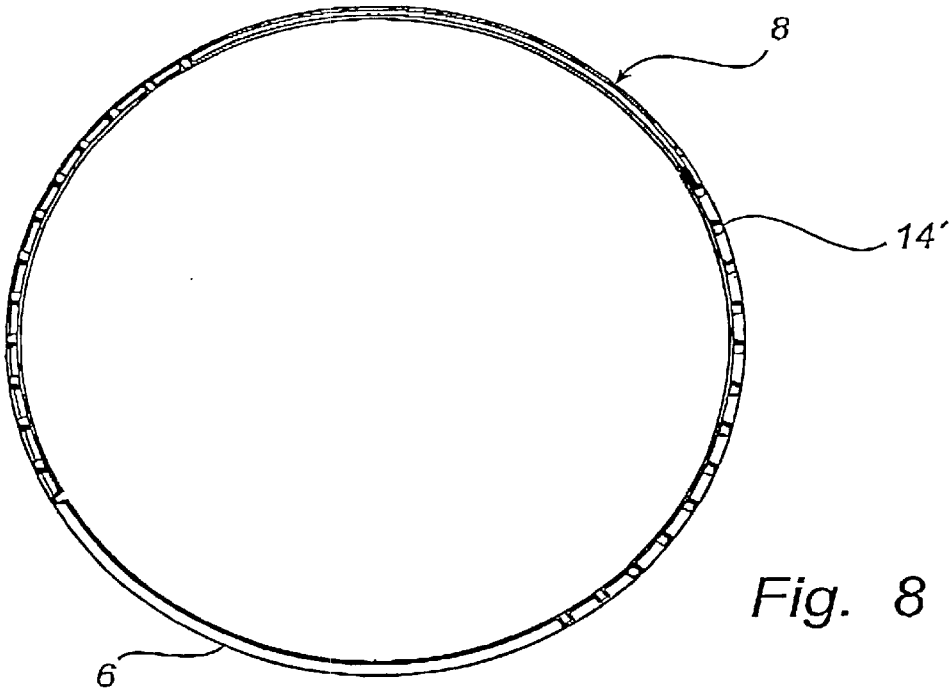
FIG. 8 is an end view of the tube shown in FIG. 7.

The finished tube 8 is shown in FIGS. 7–11. As is understood from FIG. 7, the production parameters (for instance the offset of the rows of openings 4 and the forming head angle) have been adjusted in such a manner that the nozzles 14' are arranged in axial rows on the outside surface of the tube 8. It is also clear that each helical turn or winding of the strip 1 on the tube 8 has a helical row of equidistantly spaced collars 14 forming the air nozzles 14' projecting radially out of the tube wall. Thus, the tube 8 according to this embodiment has its air nozzles 14' disturbed over 360° around the tube wall (see also FIG. 12). The helical nature of the row of air nozzles 14' is apparent from the view in FIG. 8 illustrating the end of a tube 8 cut transversely through the helical row of air nozzles 14', thereby showing the adjacent bead 6.

Figure 12:
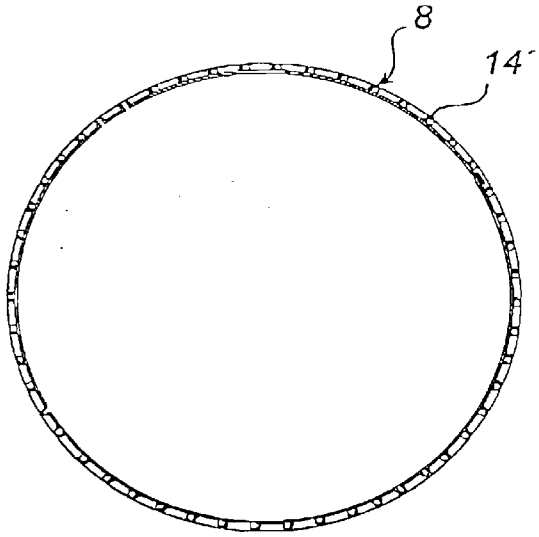
FIGS. 12–14 are slightly inclined cross-sectional views of tubes manufactured in accordance with the method of the invention and having alternative air nozzle patterns.
Figure 13:
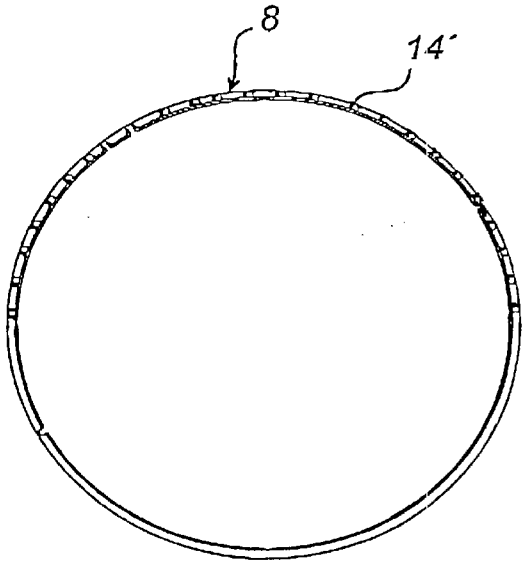
Figure 14:
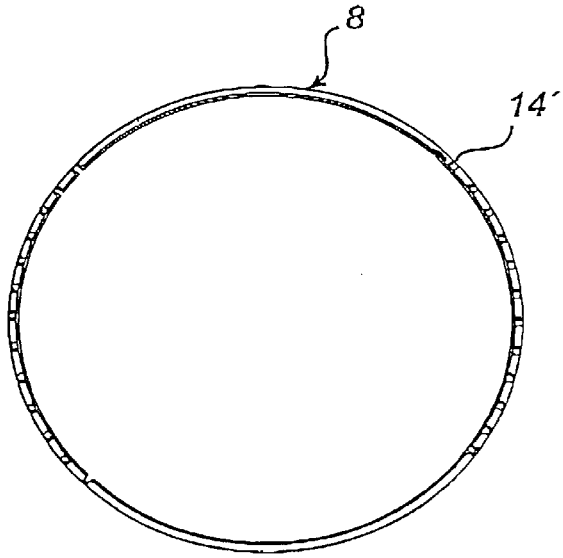

FIG. 12 shows a slightly inclined cross-section of the tube 8 (see FIG. 9) with 360° distributed air nozzles 14', whereas FIGS. 13 and 14 show variants having alternative air nozzle patterns. Each helical turn of the tube 8*a* shown in FIG. 13 has air nozzles 14' distributed over half of the tube 8*a,* that is over 180°, leaving the rest of the tube without nozzles. Each helical turn of the tube 8*b* shown in FIG. 14 has air nozzles 14' distributed over two opposite areas, a so-called 2×90° pattern.

Various air nozzle patterns can easily be achieved by operating the punching/pressing unit 3 either continuously, thus producing a 360° tube, or intermittently for production of 270°, 180°, 90° or 2×90° patterns, or any other pattern that may be desirable. The operation of the punching/pressing unit 3 is controlled by a computer (not shown) in which the desired air nozzle patterns of the finished tube 8 can be programmed.

Practical tests of the apparatus and the method of the invention have produced very good results. In one test, a sheet metal strip having a thickness of 0.7 mm and a width of 148 mm was used. A 200 mm diameter tube was produced with a 360° air nozzle pattern. The inner diameter of the air nozzles was 5 mm and the center-to-center distance between two adjacent air nozzles in the helical row of nozzles was 24 mm. The tube was manufactured at a high strip feeding rate, and the quality of the finished tube was very good. In particular, the quality of the collars defining the air nozzles was excellent, far better than in hitherto known tubes of a similar type, such as the tubes of the ACTIVENT system. The precisely controlled punching and pressing operation of the unit 3 leads to the good quality of the air nozzles.

The invention is especially, but not exclusively, adapted for ventilation ducts having a diameter in the range of 200–500 mm. The diameter of the air nozzles is preferably in the range of 3–10 mm, and the center-to-center distance between two adjacent air nozzles in the helical row of nozzles is preferably in the range of 15–30 mm.

Finally, it should be mentioned that the invention is by no means restricted to the embodiments described herein, and various modifications are feasible within the scope of the appended claims. For instance, the specific design and the arrangement of the air nozzles may vary.

What we claim and desire to secure by Letters Patent is:

1. A method of manufacturing a helically-wound lock-seam tube for a ventilation duct system, and tube having a plurality of air nozzles through its wall, comprising the steps of:

a) feeding a strip of sheet metal from a supply to a punching and pressing unit;

b) punching and pressing said strip in said punching/pressing unit to form at least one longitudinal row of spaced openings through said strip, each of said openings being defined by a collar formed of strip material and projecting from one surface of said strip;

c) feeding said punched strip to a roller unit, in which at least one longitudinal bead is formed in said strip in parallel with said at least one row of openings:

d) feeding said punched and beaded strip to a forming head in which said strip is helically wound to form a tube having a helical lock seam, wherein each helical turn of said tube has at least one row of spaced openings forming said air nozzles projecting radially out of said tube wall;

e) feeding said helically-wound lock-seam tube out of said forming head; and f) cutting said tube into desired lengths.

2. The method of claim 1, wherein two parallel rows of openings are formed in said strip, and a bead is formed inbetween these two rows of openings.

3. The method of claim 1, wherein said punching/pressing unit is adjusted in such a manner that said air nozzles of a finished tube are arranged in axial rows parallel with a center axis of the tube.

4. The method of claim 1, wherein said punching/pressing unit is either continuously operated such that a finished tube is formed with air nozzles equidistantly spaced in a helical row throughout said tube, or intermittently operated such that a finished tube is formed with at least one axially extending surface having no air nozzles.

5. The method of claim 1, wherein an angle between a center axis of said tube fed out of said forming head and a strip feeding direction in said roller unit is adjusted in accordance with a desired diameter of said tube, said adjustment being such that said feeding direction of said strip between a strip output of said punching/pressing unit and a strip intake of said roller unit is maintained straight.

6. The method of claim 5, wherein said angle is adjusted by turning said forming head with respect to said roller unit which is stationary.

7. The method of claim 1, wherein operations of said punching/pressing unit and said roller unit are controlled in such manner that a radical projection of said bead with respect to said tube wall is greater than a radial projection of said air nozzles.

8. An apparatus for manufacturing a helically-wound lock-seam tube for a ventilation duct system, said tube having a plurality of air nozzles through its wall, comprising:

a) a supply of a sheet metal strip;

b) a punching/pressing unit for punching and pressing said strip fed from said supply to form at least one longitudinal row of spaced openings through said strip, each of said openings being defined by a collar formed of strip material and projecting from one surface of said strip;

c) a roller unit for rolling said punched strip fed from said punching/pressing unit to form at least one longitudinal bead in said strip in parallel with said at least one row of openings;

d) a forming head for forming said punched and beaded strip to a helically-wound lock-seam tube, wherein each helical turn of said tube has at least one row of spaced openings forming said air nozzles projecting radially out of said tube wall;

e) means for feeding said helically-wound lock-seam tube out of said forming head; and f) means for cutting said tube into desired lengths.

9. The apparatus of claim 8, wherein said punching unit has means for forming two parallel rows of openings in said strip.

10. The apparatus of claim 9, wherein said punching/pressing unit comprises two members, one of which is displaceable with respect to the other in order to form a first row of openings which is offset relative to a second row of openings formed by said other member of said punching/pressing unit.

11. The apparatus of claim 10, wherein said displacement of said displaceable member of said punching/pressing unit is adjustable in accordance with a diameter of a finished tube, said offset between said two rows of openings decreasing by an increasing tube diameter and vice verse.

12. The apparatus of claim 10, wherein said roller unit forms said bead between said two longitudinal rows of openings.

13. The apparatus of claim 10, wherein said displacement of said displaceable member of said punching/pressing unit is adjustable in such manner that said air nozzles of a finished tube are arranged in axial rows parallel with a center axis of said tube.

14. The apparatus of claim 11, wherein said displacement of said displaceable member of said punching/pressing unit is adjustable in such manner that said air nozzles of a finished tube are arranged in axial rows parallel with a center axis of said tube.

15. The apparatus of claim 8, wherein said punching/pressing unit having a continuous mode of operation so that a finished tube has air nozzles equidistantly spaced in a helical row throughout said tube, and an intermittent mode of operation so that a finished tube has at least one axially extending surface having no air nozzles.

16. The apparatus of claim 8, comprising means for adjusting an angle between a center axis of said tube fed out of said forming head and a strip feeding direction in said roller unit in accordance with a desired diameter of said tube.

17. The apparatus of claim 16, wherein said forming head is mounted on a base which is turnable about a vertical axis with respect to said roller unit which is stationary and one end of which is supported on said base by a bearing assembly, thereby allowing said angular adjustment.

18. The apparatus of claim 8, wherein said roller unit has rollers with peripheral ridges for roll-pressing said strip in order to form said at least one bead.

19. The apparatus of claim 18, wherein said roller unit is adapted to form said bead between said two longitudinal rows of openings.

20. The apparatus of claim 8, wherein said forming head has internal grooves receives said radially outwards projecting air nozzles and said bead when forming said helically-wound lock seam in said forming head.

* * * * *

UNITED STATES PATENT AND TRADEMARK OFFICE

CERTIFICATE OF CORRECTION

PATENT NO. : 6,453,710 B1
APPLICATION NO. : 09/654763
DATED : September 24, 2002
INVENTOR(S) : Andresen et al.

It is certified that error appears in the above-identified patent and that said Letters Patent is hereby corrected as shown below:

on the title page, Inventors (75), "(CH)" should read --DK--;

on the title page, Inventors (75), "(DK)" should read --CH--;

Column 4, line 58, "now" should read --not--;

Column 5, line 32, "disturbed" should read --distributed--; and

Column 6, line 63, claim 7, "radical" should read --radial--.

Signed and Sealed this

Twenty-ninth Day of August, 2006

JON W. DUDAS
*Director of the United States Patent and Trademark Office*